US005107925A

United States Patent [19]

Veigel

[11] Patent Number: 5,107,925

[45] Date of Patent: Apr. 28, 1992

[54] HEAT EXCHANGER WITH A TUBE-TO-TUBE PLATE CONNECTION.

[76] Inventor: Andreas Veigel, Amtgasse 11, Lenningen, Fed. Rep. of Germany

[21] Appl. No.: 638,846

[22] Filed: Jan. 8, 1991

[30] Foreign Application Priority Data

Jan. 13, 1990 [DE] Fed. Rep. of Germany ..... 4000823
Feb. 22, 1990 [DE] Fed. Rep. of Germany ..... 4005576

[51] Int. Cl.[5] ..... F28F 9/04

[52] U.S. Cl. ..... 165/173; 285/222; 285/382.4

[58] Field of Search ..... 165/173; 285/193, 196, 285/222, 382 A

[56] References Cited

U.S. PATENT DOCUMENTS 2,099,026 11/1937 Markel et al. ..... 285/222 X
2,449,616 9/1948 Pennella ..... 165/173 X
2,557,360 6/1951 Pennella ..... 285/56

FOREIGN PATENT DOCUMENTS 333442 1/1921 Fed. Rep. of Germany ..... 285/222
2429370 2/1975 Fed. Rep. of Germany .
3328913 2/1985 Fed. Rep. of Germany .
1388690 4/1988 U.S.S.R. ..... 165/173

*Primary Examiner*—Allen J. Flanigan
*Attorney, Agent, or Firm*—W. G. Fasse

[57] ABSTRACT

In a heat exchanger, separate junction elements (3) are provided for joining the tubes (2) to the tube plate (1), whereby connection sockets (7) of the junction elements (3) reach into expanded ends of the tubes (2) in a friction-fit manner. Flanges (5) of the junction elements (3) are joined in a liquid and gas-tight manner to the tube plate (1). Thus, the production of the separate parts and their assembly is more economical, the characteristics of the tube junctions are improved, and it is possible to use any desired tube shapes and material combinations.

21 Claims, 2 Drawing Sheets

HEAT EXCHANGER WITH A TUBE-TO-TUBE PLATE CONNECTION.

FIELD OF THE INVENTION

The invention relates to heat exchangers wherein heat exchanger tubes are secured to a tube plate by a friction fit.

BACKGROUND INFORMATION

It is known to connect the heat exchanger tubes with a tube plate by means of a friction fit connection including a connecting hollow rivet.

The known constructions have the disadvantage that, on the one hand, they are costly in terms of processing and manufacturing techniques, and that on the other hand an optimal dimensional fit of the different materials is not possible in the area of the junction between the tube and the tube plate. Because of that, depending upon the construction, only relatively thick walled precision round tubes with carefully deburred ends and unscored surfaces or only certain combinations of materials can be used for manufacturing such heat exchangers. Adhering and sealing elements, such as adhesives and rubber, have the disadvantage that they are unreliable under steady and alternating stresses and under temperature and/or chemical loading. Another disadvantage of junction constructions which are rigidly joined to the tube plate, is that all tubes must be pressed-in together. For heat exchanger blocks having many small dimension tubes, considerable compression forces arise which are not compatible with the use of thin tubes.

OBJECT OF THE INVENTION

Therefore, it is the object of the invention to further develop a heat exchanger of the initially described type in such a manner that the tubes may be joined in a gas-tight manner to a tube plate made of synthetic material, while avoiding expensive methods and without requiring additional adhesive and sealing elements.

SUMMARY OF THE INVENTION

This object has been achieved according to the invention by a combination in which the tubes 2 are joined in a friction-fit manner to the tube plate 1, 20, 28 by widening or expanding its end region in a bored hole 1' of the tube plate 1, 20, 28 in that a separate junction element 3, 11, 23, 30 is provided with at least one through-hole 10, 15, of which the connection socket 7 reaches into the tube 2, 12, 19, 27 in a friction fitting manner, and of which the flange 5 is joined in a liquid and gas-tight manner to the tube plate 1, 20, 28, and in that the junction element 3, 11, 23, 30 comprises a ring-shaped groove 8, 24, 31 facing the tube plate 1, 20, 28 between the flange 5 and the connection socket 7.

By using according to the invention a separate junction element, a high radial contact pressure can be achieved, which is only limited by the material characteristics, whereby the junction is produced in three steps, so that slight lengthwise forces are applied to the thin tubes. It is also advantageous that for many tubes per heat exchanger, each tube can be joined separately or in small groups. Thus, the joining operation can be better mastered and controlled and the production is more variable.

Advantages of the invention are seen in that the production of their separate parts and the assembly becomes economically more favorable, the characteristics of the two joints are improved and it is possible to use any desired tube shapes and material combinations whereby the efficiency is improved while space requirements and costs are reduced.

The flange of the junction element must be permanently and tightly joined to the tube plate. This joining is achieved most simply by a ring-shaped tongue and groove connection which is joined when the junction element is pressed in. By paying attention to the maximum edge fiber strain of the synthetic material being used, a trouble-free tightly sealed joint is produced.

In situations where space is tight, and which require the narrowest flange possible, an ultrasonic welding process may be used. Due to the special conditions that must be met for producing a tight seam by this welding method, it is a great advantage that the junction elements can be processed singly or in a number of groups.

The ring-shaped groove of the junction element according to an embodiment of the invention serves two purposes. First, the junction element receives the tube, which under some circumstances may be burred. Second, the junction element interrupts a capillary which could be formed.

Furthermore, the invention has the considerable advantages that measurement tolerances and errors in the coaxiality of drawn tubes are compensated in wide ranges. Therefore, cheaper semi-finished tube materials can be used. The further processing of the semi-finished materials into tube pieces is also less expensive because the formation of burrs along the cut-off edges can be tolerated.

The manufacture of the tube plate as a part made of synthetic material is also simplified because a high precision, sensitive annular gap is not required. The invention uses a three step joining method, whereby the lengthwise strength or stiffness of the tubes hardly plays a role as it does in the known annular gap method, so that the wall thickness of the tubes must only be matched to the physical and operational requirements. This usually means a reduction in the wall thickness of the heat exchanger tubes whereby the quantity of material needed to make the tubes and the tube weight are reduced.

Also avoided is the danger of any lengthwise scoring while pressing the tubes into a tight-fitting annular gap, whereby, the number of rejects is reduced for heat exchangers especially those having a substantial number of tube joints. The avoidance of additional adhesive and sealing elements increases the reliability and the long duration stability of the sealing effectiveness and the chemical resistance of the joint. Finally, the teaching of the invention achieves by an appropriate material pairing and by dimensional considerations, a joint which is optimally adapted to the physically determined parameters and to the structurally limiting conditions. Nearly any desired tube shapes can be used according to the invention, whereby, it is now possible to shape the heat exchanger with due regard for efficiency. Due to the present teaching, a positive feed back exists between the internal pressure and the sealing tightness so that, especially for high internal pressures, an excellent sealing effectiveness of the junction is achieved.

A further embodiment of the present junction element, especially for flat or oval tubes, has arch-shaped stiffening reinforcements which are respectively braced against each other with intermediate spacer lands.

The arch-shaped reinforcements and spacer lands form round through-holes wherein guide elements are located. The guide elements are constructed so that they impart a spiral twist to the flowing medium or fluid in a freely selectable rotation direction. Depending on the given flow conditions a neighboring channel can cause a rotation of the fluid in the same in the opposite rotation direction. Opposing rotations achieve stable flow rollers or rather cylinders which flow along while intermeshing like gear wheels in long tubes. The rotation in the same direction achieves a good turbulence in short tubes. In order to amplify this effect, the through-holes may be formed in the shape of nozzles.

If several tubes are joined to one tube plate, it is advantageous if the several junction elements are joined into one form body by means of intermediate spacer lands which are elastically stretchable for compensating any tolerances. Thus, the production and handling are considerably simplified without losing the advantage of separate or individual pressing.

BRIEF DESCRIPTION OF THE DRAWINGS

In the following, exemplary embodiments of the invention are described in greater detail, with reference to the accompanying drawings, wherein.

DETAILED DESCRIPTION OF PREFERRED EXAMPLE EMBODIMENTS AND OF THE BEST MODE OF THE PRESENT INVENTION

Figure 1:
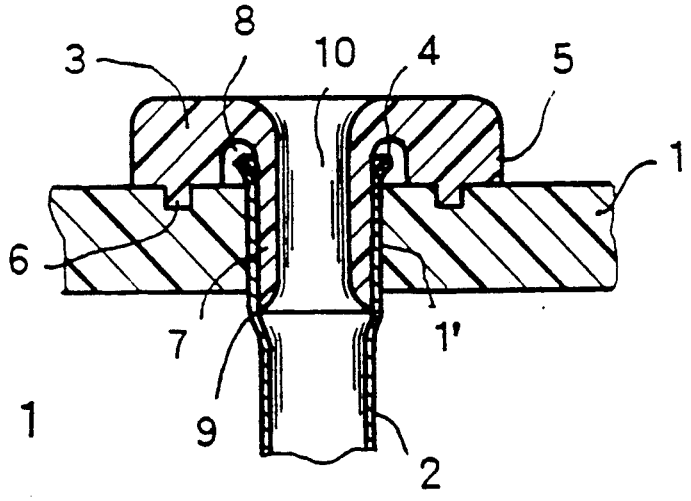
FIG. 1 shows a lengthwise section through a finished tube joint.

FIG. 1 shows a finished tube junction with a tube plate 1 made of synthetic plastic material, a tube 2 made of metal, and a junction element 3 also made of synthetic material. By means of a drawing die, which is not shown, the tube 2 has been expanded or widened in a friction fitting manner to form a flange rim 4 in the bored hole 1' of the tube plate 1 whereby the flange rim 4 at the tube end has been flared radially outwardly.

The connection socket 7 of the junction connection element 3 is pressed into the tube 2, whereby the funnel-shaped tube flange rim facilitates the pressing-in. The junction element 3 moreover, comprises a flange 5 which is joined by a tongue and groove joint 6 in a liquid and gas-tight manner, to the tube plate 1.

A ring-shaped groove 8 is provided between the flange 5 and the connection socket 7. The groove 8 provides a space for the tube flange rim 4. The groove 8 simultaneously interrupts a capillary action which could otherwise be formed. Such interruption of a capillary action is especially advantageous for low internal pressures or for negative pressures. For high internal pressures the seal is automatically strengthened between the connection socket 7 and the inner wall of the tube 2.

At its end face, the connection socket 7 comprises a sharp edge 9 which contacts the tube wall with a sharp termination. In this manner a wedging action and any back-up effect are avoided for a rapidly flowing medium which flows through the through-bored hole 10 of the connection element 3.

Figure 2:
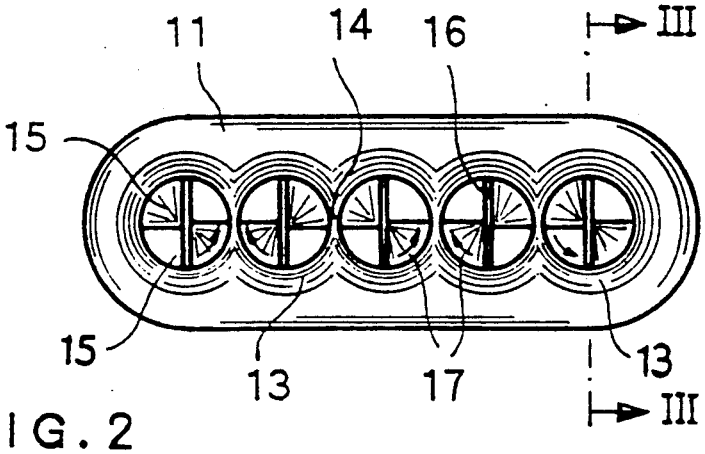
FIG. 2 shows a junction element for flat tubes from above.
Figure 3:
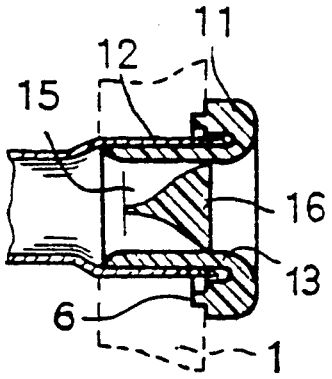
FIG. 3 shows a section along line III—III in FIG. 2.

FIGS. 2 and 3 show a further embodiment of a connection element 11 for a flat tube 12. The connection element 11 is strengthened by vaulted or arch-shaped stiffeners 13 which are braced against each other by means of stiffening webs 14. Guide elements 16 are arranged in the thus provided round through-bored holes 15, whereby the guide elements 16 are constructed in such a manner that they impart on the flowing medium a spiral twist in a freely selectable direction of rotation, as shown by arrows 17.

Figure 4:
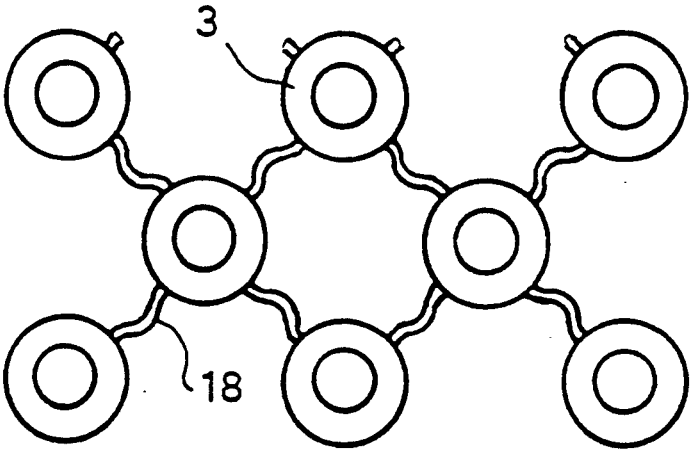
FIG. 4 shows a top view of junction elements joined to each other.

FIG. 4 shows a further embodiment of the invention, whereby the junction or rather connection elements 3 are joined by flexible intermediate spacer arms or lands 18 into a single component.

Figure 5:
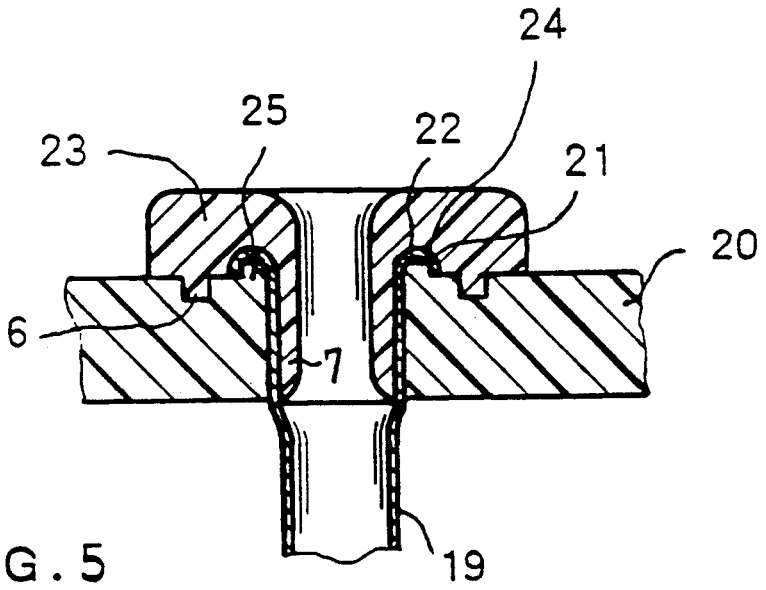
FIG. 5 and 6 show lengthwise sections through further exemplary embodiments of tube junctions.

FIG. 5 shows another embodiment of the finished tube junction, in which a tube 19 is joined in a friction-fitting manner with a tube plate 20, and the tube end 21 above the tube plate 20 has a flange rim 22 with a curved cross-section extending radially outwardly and then axially again to form an essentially U-shaped cross-section. A connection or junction element 23 is pressed into the tube 19. The connection element 23 has a ring-shaped groove 24 facing toward the tube plate 20. The groove 24 receives and encloses the flange rim 22. The tube plate 20 comprises a ring-shaped lip 25 which reaches into the groove 24 of the connection element 23 to press the flange rim 22 of the tube 19 into groove 24.

Figure 6:
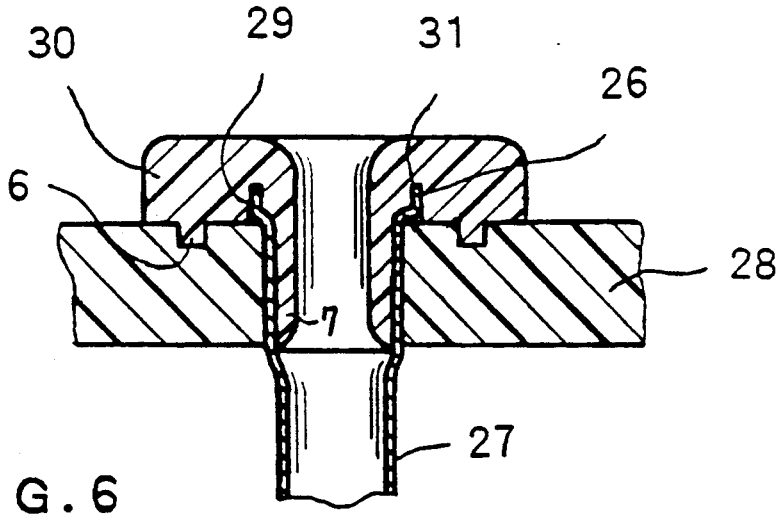

FIG. 6 shows a further embodiment of the invention in which the tube end 26 of a tube 27 above a tube plate 28, comprises a flange rim 29 also having a curved cross-section to form an essentially S-shaped configuration by an axially extending portion, a radially extending portion, and a further axially extending portion.

When a connection element 30 is pressed in, the end of the flange rim 29 is forced into a ring-shaped groove 31 of the connection element 30, whereby simultaneously a secure and reliable hold of the tube end and the final shaping of the flange rim 29 are achieved. Moreover, in this flange rim 29 the deformability of the tube material is stressed less than without such flange rim.

The last mentioned two embodiments offer the substantial advantage that the final forming of the tube end 21 or 26 is produced during the joining operation by means of the connection element 23 or 30 to provide a form-fitting joint. In this manner it is automatically assured that no tolerance play will result in the finished tube joint. Any relative motion worth mentioning, between the tube 19 or 27 and tube plate 20 or 28 is reliably prevented.

Figure 7:
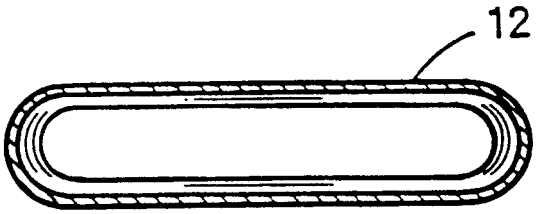
FIG. 7 is a sectional view through the end portion of a flat tube.
Figure 8:
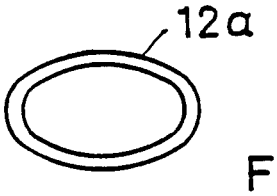
FIG. 8 is an end view of an oval tube.

FIG. 7 shows a sectional view through the flared end of the flat tube 12 shown in an axial section in FIG. 3. FIG. 8 is an end view of an oval tube 12*a*. Both tube types are used in heat exchangers of the invention.

Although the invention has been described with reference to specific example embodiments it will be appreciated that it is intended to cover all modifications and equivalents within the scope of the appended claims.

I claim:

1. A heat exchanger with tubes (2, 19, 27) joined to a tube plate (1), comprising a junction element for joining each tube end to said tube plate, each junction element comprising a flange, a connection socket defining a through-hole and a groove disposed between the flange and the connection socket (7), each of said tubes (2) being joined in a friction-fit manner to its connection socket and to said tube plate (1, 20, 28) by widening said tube end in a bored hole (1') of said tube plate (1, 20, 28), said connection socket (7) reaching into said tube end (2, 19, 27) in a friction fitting manner, said flange (5) being joined in a liquid and gas-tight manner to said tube plate (1, 20, 28) by a flange rim at each tube end reaching into said groove of said junction element, said groove (8, 24, 31) facing said tube plate (1, 20, 28) between said flange (5) and said connection socket (7) of said connection element, and wherein said flange rim of said tube end comprises a curved cross-section that is pressed into said groove, thereby forming a form-fitting joint in said groove between said flange rim at said tube end and said junction element.

2. The heat exchanger of claim 1, wherein said curved flange rim at said tube end (4, 21, 26) extends radially outwardly and then axially to form said form-fitting joint.

3. The heat exchanger of claim 2, wherein said flange rim (22) has an essentially U-shaped cross-section to form said form-fitting joint.

4. The heat exchanger of claim 3, wherein said tube plate (20) comprises a ring-shaped lip (25) which reaches into said U-shaped cross-section of said flange rim (22).

5. The heat exchanger of claim 2, wherein said flange rim (29) has an essentially S-shaped cross-section to form said form-fitting joint.

6. The heat exchanger of claim 1, wherein said form-fitting joint is formed during a pressing-in of said junction element (23, 30), in such a manner that said groove (24, 31) encloses said flange rim (22, 29) in a form-fitting manner.

7. The heat exchanger of claim 1, wherein said connection socket (7) comprises a sharp edge (9) at its end face.

8. The heat exchanger of claim 1, wherein said tube end of said tube (2) is widened to a funnel-shape.

9. The heat exchanger of claim 1, further comprising a tongue and groove joint (6) between said flange (5) of said junction element and said tube plate (1, 20, 28).

10. The heat exchanger of claim 1, comprising a guide element (16) arranged in said through-hole (15) of said junction element, said guide element (16) affecting flow characteristics of a cooling medium flowing through said tubes.

11. The heat exchanger of claim 1, wherein said junction element (11) comprises several through-holes (15) and a guide element (16) arranged in each through-hole so that a cooling medium flowing in neighboring through-holes (15) is caused to rotate in a desired rotation direction.

12. The heat exchanger of claim 1, further comprising intermediate spacer arms (18) interconnecting said junction elements (3).

13. The heat exchanger of claim 12, wherein said intermediate spacer arms (18) are made of stretchable material.

14. The heat exchanger of claim 1, wherein said tube plate is constructed of a synthetic plastic material.

15. The heat exchanger of claim 1, wherein said groove disposed between said flange and said connection socket is a ring-shaped groove.

16. The heat exchanger of claim 1, wherein said tubes are flat tubes (12).

17. The heat exchanger of claim 16, wherein said junction element comprises a plurality of through-holes all leading into a respective flat tube of said flat tubes.

18. The heat exchanger of claim 1, wherein said tubes are oval tubes.

19. The heat exchanger of claim 18, wherein said junction element comprises a plurality of through-holes all leading into the same oval tube.

20. A heat exchanger with tubes (2, 19, 27) joined to a tube plate (1), comprising a junction element for joining each tube end to said tube plate, each junction element comprising a flange, a connection socket defining a through-hole and a groove disposed between the flange and the connection socket (7), each of said tubes (2) being joined in a friction-fit manner to its connection socket and to said tube plate (1, 20, 28) by widening said tube end in a bored hole (1') of said tube plate (1, 20, 28), said connection socket (7) reaching into said tube end (2, 19, 27) in a friction fitting manner, said flange (5) being joined in a liquid and gas-tight manner to said tube plate (1, 20, 28) by a flange rim at each tube end reaching into said groove of said junction element, said groove (8, 24, 31) facing said tube plate (1, 20, 28) between said flange (5) and said connection socket (7) of said connection element, and further comprising a tongue and groove joint (6) between said flange (5) of said junction element (3, 23, 30) and said tube plate (1, 20, 28).

21. The heat exchanger of claim 20, wherein said tube plate has a lip (25) projecting into said groove (24) of said junction element, thereby pressing said flange rim (22) of said tube (19) into said groove (24) with a press-fit .

* * * * *